US007914388B2

(12) United States Patent
Cox

(10) Patent No.: US 7,914,388 B2
(45) Date of Patent: Mar. 29, 2011

(54) GOLF SWING TRAINING APPARATUS

(75) Inventor: Robert William Cox, Brisbane (AU)

(73) Assignee: The Cox Family Trust, Brisbane, Queensland (AU)

( * ) Notice: Subject to any disclaimer, the term of this patent is extended or adjusted under 35 U.S.C. 154(b) by 0 days.

(21) Appl. No.: 11/651,635

(22) Filed: Mar. 5, 2007

(65) Prior Publication Data

US 2007/0149301 A1 Jun. 28, 2007

(51) Int. Cl.
*A63B 69/36* (2006.01)

(52) U.S. Cl. ..... 473/212; 473/207; 473/266

(58) Field of Classification Search ..... 473/201, 473/203, 206, 207, 212, 219, 226, 227, 231, 473/266, 422, 223, 276
See application file for complete search history.

(56) References Cited

U.S. PATENT DOCUMENTS 5,009,426 A * 4/1991 Cox ..... 473/227
5,904,624 A * 5/1999 Martinez ..... 473/212
5,954,591 A * 9/1999 Liberatore ..... 473/206
5,976,024 A * 11/1999 Marshall, Jr. ..... 473/227
6,358,156 B1 * 3/2002 Moran ..... 473/219
6,416,419 B1 * 7/2002 Foresi ..... 473/227
6,881,155 B2 * 4/2005 Rohan-Weaver ..... 473/219
7,033,282 B1 * 4/2006 Flood ..... 473/227
7,033,284 B2 * 4/2006 Yoshimura ..... 473/276
2003/0207717 A1 * 11/2003 Ulrich ..... 473/201

* cited by examiner

*Primary Examiner* — Nini Legesse

(57) ABSTRACT

A golf swing training apparatus consisting of positioning, indicating and guidance means cooperable with a golf club for learning, practicing and performing essential components of a swing method based on a concept of a lower swing phase related predominantly to a vertical virtual axis around which the body rotates, an upper swing phase related predominantly to a horizontal virtual axis tied to the vertical virtual axis and around which the arms swing and a "wrist cocking plane" maintained in a fixed relationship to the forearms, said essential components being: appropriate gripping formation; configuration of the forearms wrists hands and club when the wrists are fully cocked within the "wrist cocking plane", appropriate relationships of arms, wrists, hands and club to the lower body in the lower swing phase; and relationship of the club and 'wrist cocking plane" to the shoulders at the end of the backswing.

8 Claims, 5 Drawing Sheets

GOLF SWING TRAINING APPARATUS

FIELD OF THE INVENTION

The present invention relates to golf swing instruction and training means and devices relating thereto.

BACKGROUND OF THE INVENTION

There are many combinations of various biomechanical actions capable of maneuvering a golf club for a successful strike on a golf ball providing that they are relevantly related to a viable underlying concept.

Generally, golf swing instruction has been based on obvious aspects of the techniques of elite golfers as elicited from direct observation, photographs, films, and videos and as interpreted from their own descriptive writings.

That process envisages the actions associated with those technique aspects as relating directly to an ideal universally applicable single "swing plane" concept based on the slanted plane of action of the golf club head and assumes therefore that those actions are selectively adaptable to any other technique.

Ground rules of instruction evolving out of those perceptions are flawed because it is not within the biomechanical capabilities of the human form to appropriately perform actions relating directly to the slanted "swing plane" which, for an elite golfer, is actually the result of the observed actions being performed, either consciously or accidentally, in the context of a non-observable underlying secondary concept adapted to accommodate the biomechanical limitations.

For that reason the many devices that have been provided in the past for practicing aspects of golf strokes in accordance with those principles of instruction, without reference to a biomechanically appropriate underlying concept, have had limited effectiveness in inducing worldwide improvement in ball striking capability among ordinary golfers.

Those shortcomings in the prior art are overcome in the present invention which provides means for instruction and training in the execution of a golf swing method based on a concept of there being a lower phase related predominantly to a vertical virtual axis about which the body rotates and which melds smoothly through transitions with an upper phase related predominantly to a horizontal virtual axis which is tied to the vertical virtual axis and about which the arms swing.

When a golfer adopts an appropriate stance for a golf stroke the vertical virtual axis rises from midway between the ankles passing through the front of the lower body and out of the upper body midway between the shoulder blades at which point the horizontal virtual axis is tied to the vertical virtual axis in the vicinity thereof.

The combined action of the body turning around the vertical virtual axis and the arms swinging around the horizontal virtual axis results in the slanted "swing plane"

BRIEF SUMMARY OF THE INVENTION

In this Brief Summary and in the following Descriptions;

the terms "leading" and "trailing" refer to the forward ball striking action;

the terms "golf club" or "club" refer to a real or representation of a golf club "wrist cocking plane" refers to a reference plane bisecting the club shaft longitudinally in which the club is rotated whilst cocking the wrists and which stands vertically and right angled to the target direction alignment when the said golf club is held by a user in the position of readiness for the commencement of a golf stroke.

"vardon" refers to a universally recognized method for gripping a golf club

The invention resides in interrelated positioning, indicating and guidance means which are co-operable structurally and functionally with a golf club to provide for learning, practicing and performing any, some, or all of the essential aspects of the previously described golf swing method, those essential aspects being:

positioning and setting of the hands while gripping the club in a "vardon" style formation in respect to the wrist cocking plane, cocked wrist configuration, alignment of the grip formation and consequently the club shaft at the ball address and transition positions, relationships of the arms, wrists, hands, and club shaft in respect to the vertical virtual axis by reference to the lower body in the lower phase and the transitions, and configuration at the top of the backswing in respect to the said vertical virtual axis and the said horizontal virtual axis by reference to the extremity of the trailing shoulder.

DETAILED DESCRIPTION OF THE INVENTION

To properly understand the basis of this invention a description of the method relating to the said concept is now provided with reference to FIGS. 1*a*, 1*b*, 1*c* and 1*d* of the drawings.

Figures 1A, 1B, 1C, 1D:
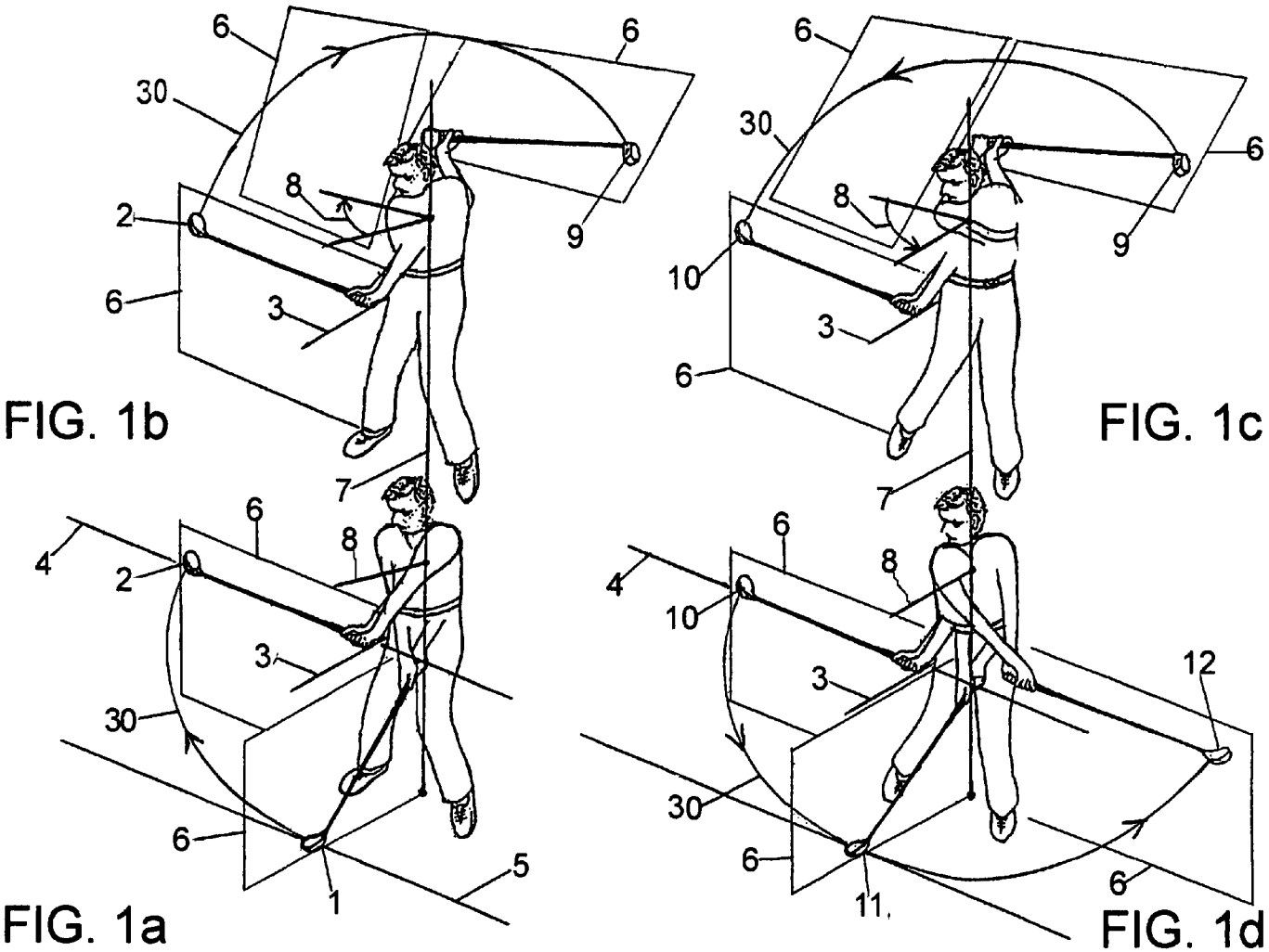
FIGS. 1*a*, 1*b*, 1*c* and 1*d* illustrate, sequentially, the performance of the golf swing method in accordance with the previously described concept wherein the line of action of the golf club within a slanted "swing plane" derives from the combined actions relating to a vertical virtual axis about which the body rotates and to a horizontal virtual axis which is tied to the vertical virtual axis and about which the arms swing.

FIG. 1*a* illustrates that in the lower phase of the backswing the club is moved away from the ball address position 1 to a phase transition position 2 wherein the club shaft is disposed with the proximal end of the handle substantially in forward alignment with the outside of a user's trailing thigh 3 and substantially on a line 4 which includes the location of the said proximal end as it was at the ball address position and which is parallel to the ground and to the line 5 extending away from a golfing target through the ball location. This is achieved biomechanically by cocking the wrists vertically within the "wrist cocking plane" 6 accompanied by the body turning in unison with longitudinal rotation of the leading arm effectively around a vertical virtual axis 7. During this turning action the trailing elbow folds back to the side of the body while the grip setting of the hands on the club and the relationship between the "wrist cocking plane" and the leading arm are maintained as they were established at address.

FIG. 1*b* illustrates that at the phase transition 2 the leading arm starts to carry the club upwards around a horizontal virtual axis 8 which is tied to the vertical virtual axis 7 in the vicinity of the upper torso. As the arms rise towards the top of the backswing position 9 the grip setting and the relationship between the "wrist cocking plane" and the leading forearm are maintained while the trailing arm continues to fold at the elbow. "The wrist cocking plane" 6 becomes slanted away from the vertical due to continuation of longitudinal rotation of the leading forearm. It is essential that the correct configuration is achieved at the top of the backswing 9

FIG. 1*c* illustrates the upper phase of the downswing which is conceptually the reverse of the upper part of the backswing but different in the synchronisation of some of the movements due to biodynamic effects as muscular power is applied to acceleration of the club head and due to the effects of centrifugal forces developed therefrom. It is essential that those effects are controlled particularly in respect to maintenance of the grip setting and the relationship between the "wrist cocking plane" and the leading arm such that the configuration through the transition 10 from the upper to the lower phase is the same as it was in the transition 2 from the lower to the upper phase in the backswing as described previously.

FIG. 1*d* illustrates the lower part of the downswing in which the club sweeps from the transition 10 through ball impact 11 and on to a follow through transition 12 where the club points at the target in essentially a mirrored configuration of the backswing transition 2. As in the upper phase of the downswing it is essential that the biodynamic and centrifugal force effects are controlled particularly in respect to maintenance of the grip setting, the relationship between the "wrist cocking plane" and the leading arm and the relationship between the hands and the club to the lower body as the body turns in unison with longitudinal rotation of the leading arm effectively around the vertical virtual axis 7 whilst straightening the trailing elbow.

The arms then carry the club upwards into the follow through from the transition 12 around the horizontal virtual axis 8 while the body continues to turn around the vertical virtual axis 7 to finish facing the target.

The effect of the arms swinging around the horizontal virtual axis 8 combined with the body's rotation around the vertical virtual axis 7 whilst maintaining the relationship between the "wrist cocking plane" 6 and the leading arm is to produce the line of action of the club head 32. within a slanted plane.

The crux of this invention is constituted in the functional form of the various positioning, indicating and guidance means and their interrelated functional and structural relationships to an associated golf club and the "wrist cocking plane".

Figure 2:
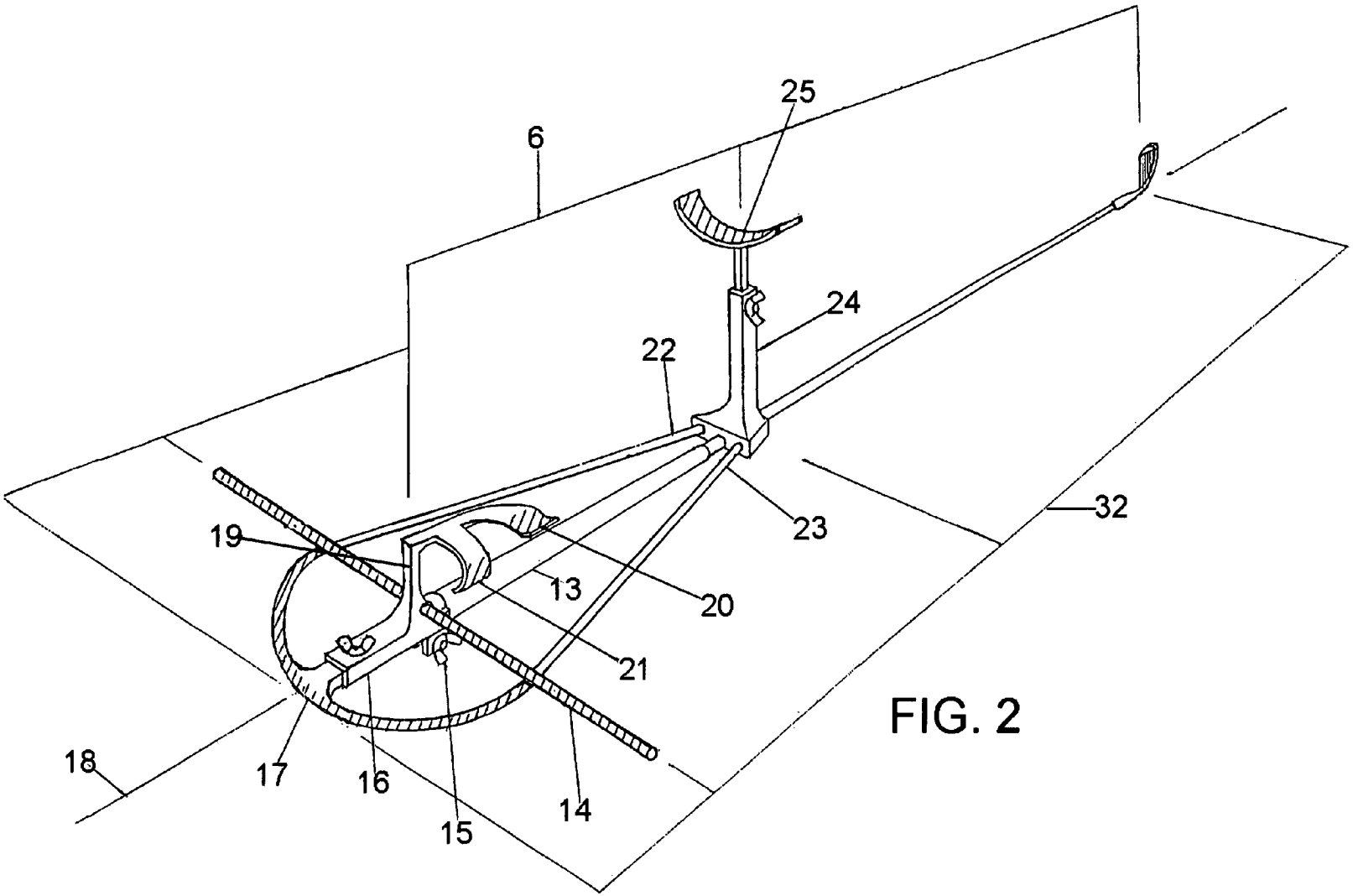
FIG. 2 is a typical embodiment of the invention arranged to suit right handed use.

FIG. 2 of the drawings illustrates the assembly of the means for learning, practicing and performing all of the essential components of the said method in a typical embodiment of the invention in which:—

The means for positioning and setting of the hands in gripping a golf club 13 with the assembly attached thereto are by thumb base positioning portions 20 and 21 which are located such that with a "vardon" style gripping formation while holding the club at the ball address position; a user's thumb bases will press firmly against the positioning portions 20 and 21 when the thumb of the first placed hand is set longitudinally on the club handle and offset to more or less 30 angular degrees from the "wrist cocking plane" 6 towards the trailing side around the club handle and the forearms are presented so as to set the top end of each wrist hinging axis inwards to more or less 30 angular degrees from the vertical.

The means for aligning the grip formation and consequently the club handle and shaft 13 in the address and transition positions is by reference to a visibly prominent alignment indicator 14 consisting of linear sections extending either in continuity or offset on each side of and at right angles to the "wrist cocking plane" 6 in the vicinity of the said proximal end of the club handle such that correct alignment is indicated at the ball address position when the linear portion 14 is horizontal and parallel to the line from a golfing target through the ball position and horizontal and at right angles thereto at the transitions whereat the lengths of each section are such that a segment of the free end thereof will be in contact relevantly with the outside of a user's thigh.

The means for establishing the cocked wrist configuration is by reference to the visibly prominent linear portion 14 which, when at the position of readiness to commence a golf stroke, is kept in horizontal alignment and parallel to the line from a golfing target through the ball position so as to keep the "wrist cocking plane" 6 vertically right angled thereto while raising the club head by a wrist cocking action of progressively and equally increasing the angular inward setting of the wrist hinge axes and hinging the hands backwards while maintaining the previously described grip setting with the leading arm in continuous extension and with slight bending of the trailing elbow.

The means for guiding the operational relationship of the arms, wrists, hands, and club handle and shaft relative to the lower body in the lower phase and transitions is provided by a lower swing phase guide portion 17 in the form of an arc spaced convexly and symmetrically away from the said proximal end of the club handle on the extended axis 18 of the club shaft and within the plane containing the visibly prominent linear portion 14 and the axis 18 of the club shaft whereby the lower swing phase guide portion 17 may be maintained in contact with a user's lower body while maneuvering the club 13 through the lower swing phase and when at a phase transition whereat a relevant end section of the linear portion 14 may also be in abutment contact with a relevant side of the lower body.

The means for establishing the top of the backswing configuration is provided by a backswing position guide 25 being in the form of a concave shoulder contact portion spaced from and concaved towards the club shaft 13 and set symmetrically crosswise to the "wrist cocking plane" 6 at a projected distance from the said proximal end of the club handle such that with the club raised to outside and above a user's trailing shoulder with the user's hands at more or less eye level and with the leading arm close to the upper body with the wrists cocked to 90 degrees, the "wrist cocking plane" 6 will be at more or less 45 angular degrees to the through line of the user's shoulders when the concavity of the backswing position guide 25 is resting in conformity over the rounded form of the extremity of the user's trailing shoulder.

The means of support to the portions of the assembly may be in any suitable non-interfering form capable of rigidly maintaining the structural relationships as would be readily conceivable by any person with appropriate engineering design skills and including adjustment means as deemed necessary to suit individual user physiques as well as any method of releasable attachment to any golf club or for fixed attachment to a dedicated golf club.

In order that this invention may be more readily understood and put into practical effect in regard to the golf swing method which is based on the concept as elucidated in FIGS. 1*a*, 1*b*, 1*c* and 1*d* of the accompanying drawings, reference will now be made to the remaining drawings.

Referring again to FIG. 2 which illustrates a typical embodiment of the invention; it will be seen that the form of the constituent functional portions of the assembly (highlighted by crosshatching) relate structurally to each other and to an attached golf club 13 and the "wrist cocking plane" 6. One form of suitable support means is shown being a triangular frame wherein the visibly prominent linear portion 14 is adapted as the base member and incorporates a clamp 15 or other suitable means for attachment to the proximal end of the club handle. An ancillary member 16 provides longitudinally adjustable support to the lower body guide 17 in reference to the said proximal end and within the plane 32 containing the linear portion 14 and the club shaft axis 18. A second ancillary member 19 rises from the vicinity of the said proximal end within the "wrist cocking plane" 6, and at right angles to the linear portion 14 and the club shaft axis 18 in support of the thumb base positioning portions 20 and 21. The two side members of the frame 22 and 23 extend from the base member/linear portion 14 to meet in the apex of the triangular form at the distal end of the club handle whereat a third ancillary member 24 rises within the "wrist cocking plane" 6, at right angles to the club shaft 13, in adjustable support of the concave backswing position guide 25 in reference to its spacing from the club shaft 13. The third ancillary member 24 incorporates a second clamp or a clip for attachment to the club shaft 13 at that point.

Figure 3:
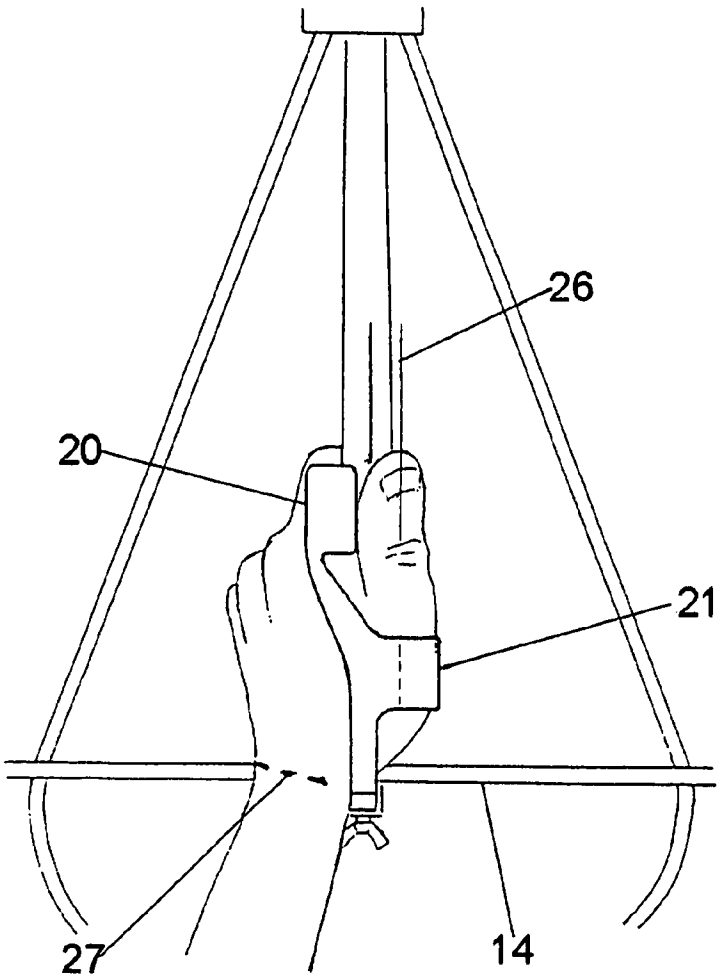
FIG. 3 shows the associated gripping arrangement of the leading or first placed hand in respect to the typical embodiment.

FIG. 3 illustrates a user's view of the grip setting by the first placed hand in respect to the thumb base positioning portions 20 and 21 with the linear portion 14 horizontal and the thumb located longitudinally at more or less 30 angular degrees 26 around the club handle from its longitudinal top centre towards the trailing side and with the wrist hinging axis 27 set at more or less 30 angular degrees from the vertical.

Figure 4:
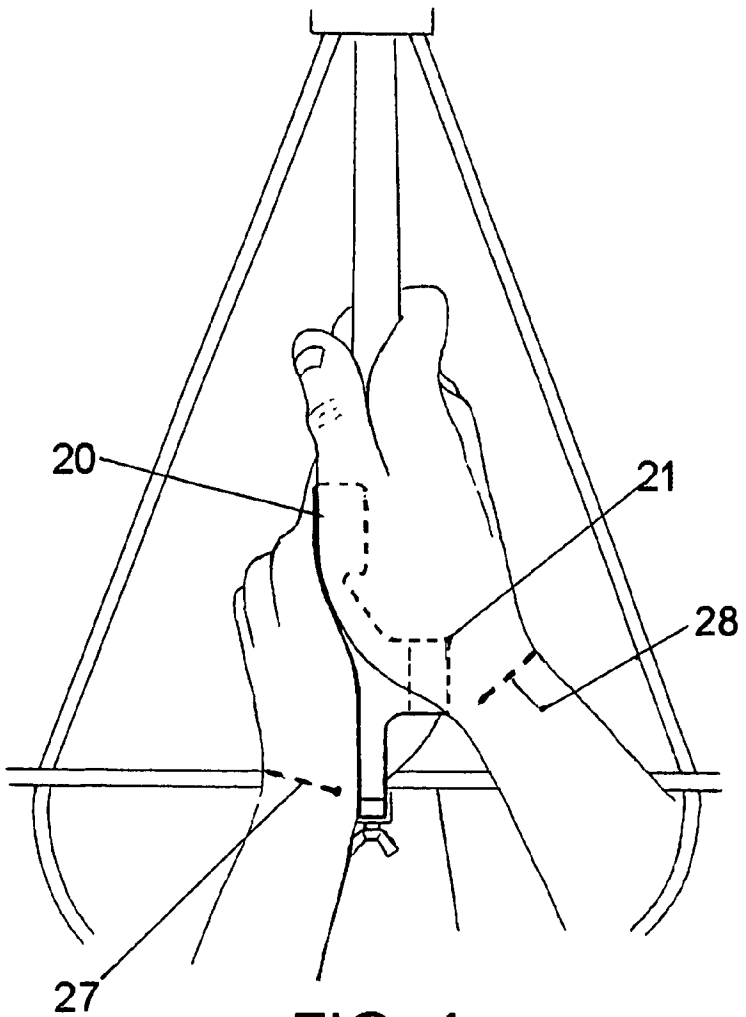
FIG. 4 shows the completed "vardon" style gripping arrangement in respect to the typical embodiment with the second placed hand in place over the first placed thumb.

FIG. 4 illustrates the complete "vardon" style gripping set up with the thumb bases against the thumb base positioning portions 20 and 21 and the wrist hinging axes 27 and 28 set inwards to each other at more or less 30 angular degrees from the vertical.

FIGS. 5*a*, 5*b*, 5*c* and 5*d* are sequential illustrations of the lower swing phase in overhead view of the relationship of the apparatus to the lower body 31 and to a target line 5.

Figure 5A:
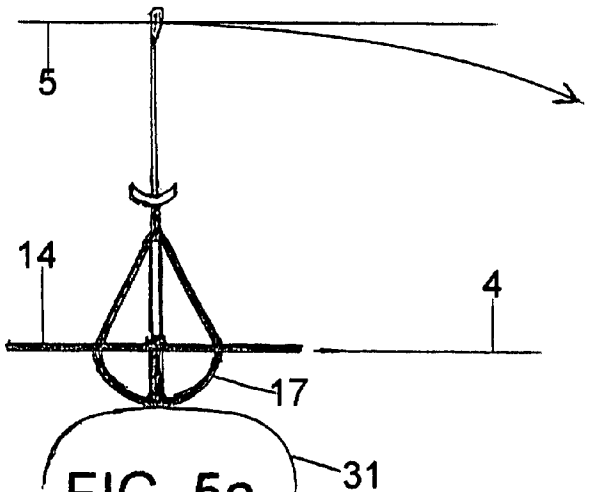
FIGS. 5*a*, 5*b*, 5*c* and 5*d* are sequential illustrations of the lower swing phase in overhead view of the relationship of the apparatus to the lower body and to a target line.

FIG. 5*a* illustrates the ball address position with the lower body guide 17 against the front of the lower body 31 and the linear portion 14 horizontal and visibly parallel to the line 5 extending from a golfing target through the ball position.

Figure 5B:
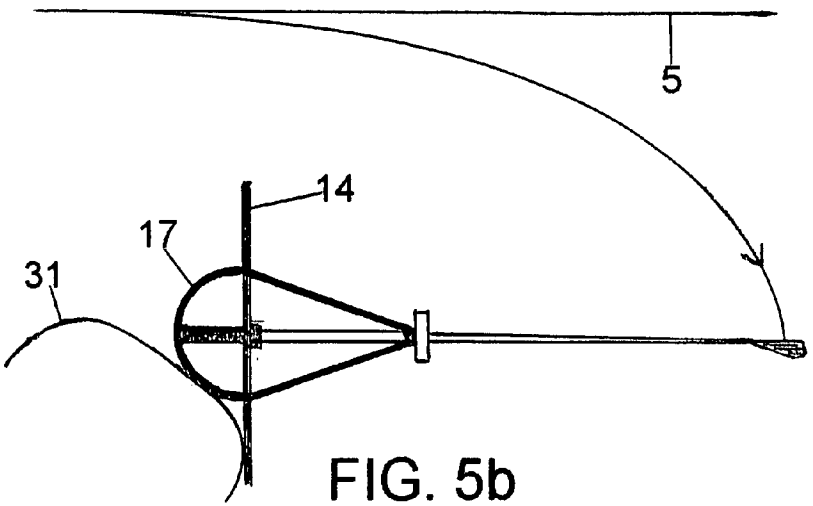

In FIG. 5*b*; the lower body guide 17 has rolled across the front of the turning lower body 31 with longitudinal rotation of the leading arm and some folding of the trailing elbow to bring the club into the backswing/downswing transition wherein the linear portion 14 is horizontal and visibly right angled to the target line 5 with a relevant end section of the linear portion 14 abutting the trailing side of the lower body and with the club shaft disposed substantially on the line 4 which extends through the proximal end of the club handle at the ball address position FIG. 5*a* and which is parallel to the ground and to the target line 5.

Figure 5C:
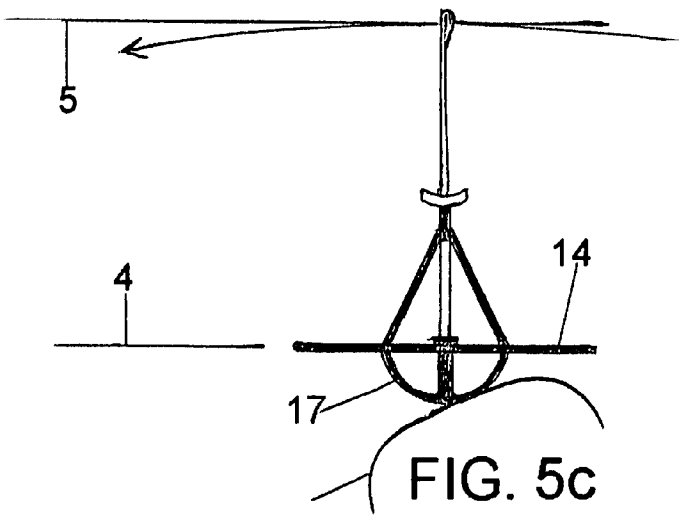
Figure 5D:
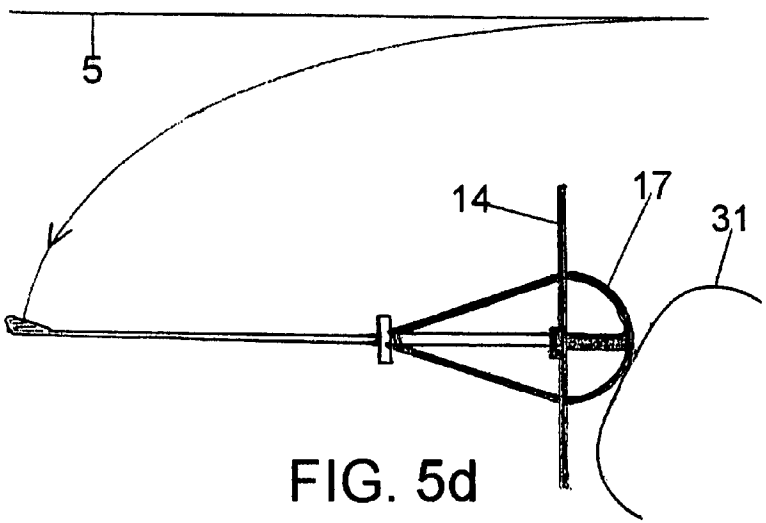

FIG. 5*c* illustrates the ball impact position which is substantially the same as the ball address position except that due to dynamic effects the lower body 31 is turning targetwise.

FIG. 5(*d*) illustrates the follow through transition which substantially mirrors the backswing/downswing transition while the lower body 31 has continued to turn towards the target.

Figure 6:
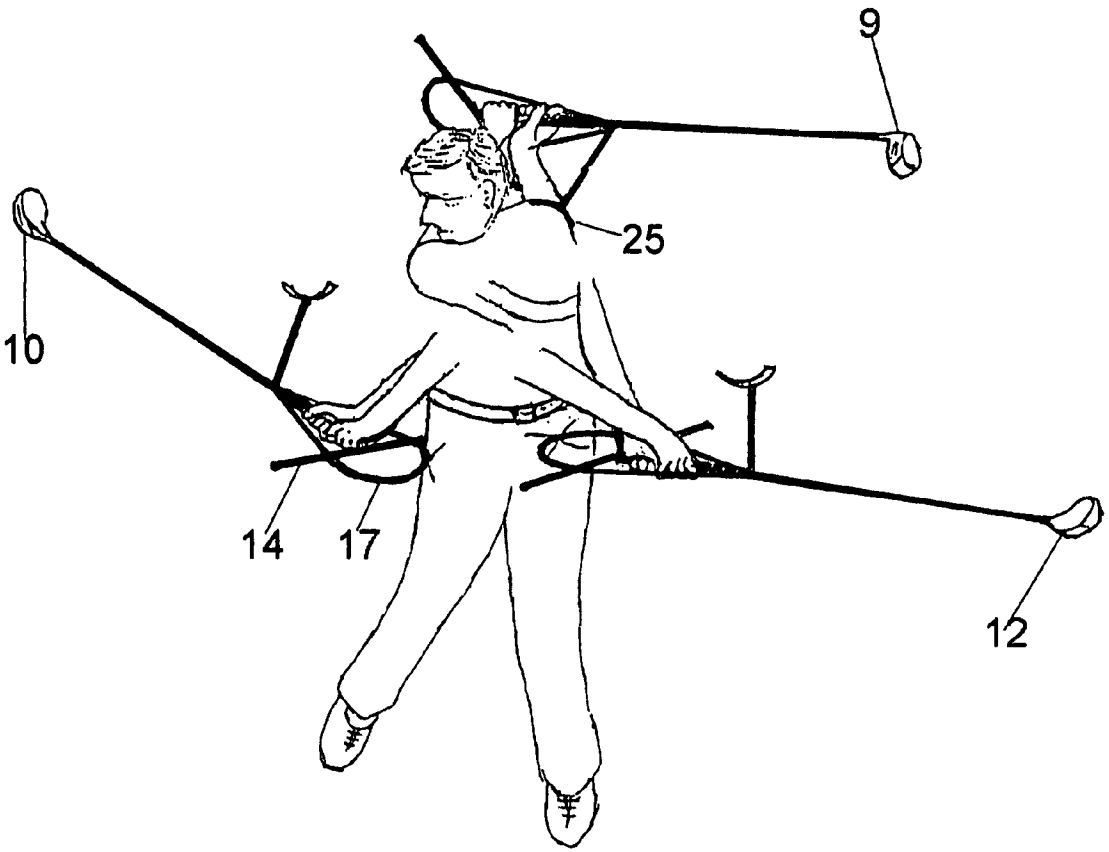
FIG. 6 illustrates the use of the typical embodiment.

FIG. 6 illustrates the apparatus in full forward swing ball striking performance wherein, at the top of the backswing 9, the wrists are fully cocked with the concavity of the backswing position guide 25 resting in conformity on the rounded form of the user's trailing shoulder extremity. At the downswing phase transition 10 the visibly prominent linear portion 14 is horizontal and right angled to the line from a golfing target through the ball with the relevant end section abutting the outside of the user's trailing hip and the lower body guide 17 against the front of that hip. The lower body guide 17 then rolls across the front of the lower body as the wrists uncock through ball impact and then recock into the follow through transition 12.

Figure 7:
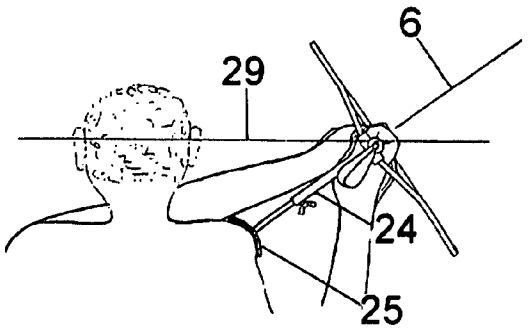
FIG. 7 elaborates the configuration at the end of the backswing position.

FIG. 7 illustrates a rearward view of the configuration at the top of the backswing position with the user standing upright, wherein the concavity of the backswing position guide 25 is resting in conformity over the rounded extremity of the user's trailing shoulder so that the "wrist cocking plane" 6 and thus the wrist cocking direction are set at more or less 45 angular degrees to the vertical and with the hands more or less at the user's eye level 29 with the support 24 adjusted to provide the appropriate spacing between the club and the user's trailing shoulder such that the club shaft would be substantially parallel to the ground and right angled to the line of the shoulders.

The claims defining the invention are as follows:

1. A golf swing training apparatus comprising a golf club with a handle, a shaft with longitudinal axis and a club head; an arcuate lower swing phase guide that is used for engagement with a golfer's lower body; a visibly prominent alignment indicator which is used for monitoring the alignment of the club shaft; thumb base positioning portions used for setting the golfer's hands in gripping the club handle; an adjustable concave shaped backswing position guide that is used for engagement of the golfer's shoulder during a backswing; various ancillary members; wherein a first ancillary member is positioned substantially inline with the shaft's longitudinal axis with one of its ends attached to the butt end of the handle; wherein the said arcuate lower swing phase guide is attached to the first ancillary member in convex and substantially symmetrical structure away from the club handle; wherein the first ancillary member contains the said visibly prominent alignment indicator which is constituted in two linear portions extending on opposite sides and right angled to it; wherein the linear portions cross and extend beyond the said arcuate swing phase guide; wherein a second ancillary member is positioned perpendicular to the line of the linear portions with one end attached to the first ancillary member; wherein the said thumb base positioning portions are supported by the second ancillary member; wherein a third ancillary member is attached at a right angle to the club shaft below the club handle; wherein the said adjustable concave shaped backswing position guide is attached to the third ancillary member; wherein the third ancillary member corresponds to the second ancillary member in respect to its perpendicularity to the line of the linear portions.

2. A golf swing training apparatus according to claim 1, wherein there is connection between the first and third ancillary members by way of two side members extending from the said arcuate lower swing phase guide to meet in an apex of a triangular form in attachment to the third ancillary member.

3. A golf swing training apparatus according to claim 1, wherein there is connection between the third and first ancillary members by way of a single connecting member.

4. A golf swing training apparatus according claim 1, wherein there are various clamps some of which would allow for the apparatus to be dismantled and others for adjustments to suit golfers with different physiques.

5. A golf swing training apparatus comprising a club with a handle, a shaft with longitudinal axis and a club head, said club being capable of representing the function of a golf club in a simulated golf swing; an arcuate lower swing phase guide that is used for engagement with a golfer's lower body; a visibly prominent alignment indicator which is used for monitoring the alignment of the shaft; thumb base positioning portions used for setting the golfer's hands in gripping the handle; an adjustable concave shaped backswing position guide that is used for engagement of the golfer's shoulder during a backswing; various ancillary members; wherein a first ancillary member is positioned substantially inline with the shaft's longitudinal axis with one of its ends attached to the butt end of the handle; wherein the said arcuate lower swing phase guide is attached to the first ancillary member in convex and substantially symmetrical structure away from the handle; wherein the first ancillary member contains the said visibly prominent alignment indicator which is constituted in two linear portions extending on opposite sides and right angled to it; wherein the linear portions cross and extend beyond the said arcuate swing phase guide; wherein a second ancillary member is positioned perpendicular to the line of the linear portions with one end attached to the first ancillary member; wherein the said thumb base positioning portions are supported by the second ancillary member; wherein a third ancillary member is attached at a right angle to the shaft below the handle; wherein the said adjustable concave shaped backswing position guide is attached to the third ancillary member; wherein the third ancillary member corresponds to the second ancillary member in respect to its perpendicularity to the line of the linear portions.

6. A golf swing training apparatus according to claim 5, wherein there is connection between the first and third ancillary members by way of two side members extending from the said arcuate lower swing phase guide to meet in an apex of a triangular form in attachment to the third ancillary member.

7. A golf swing training apparatus according to claim 5, wherein there is connection between the third and first ancillary members by way of a single connecting member.

8. A golf swing training apparatus according to claim 5, wherein there are various clamps some of which would allow for the apparatus to be dismantled and others for adjustments to suit golfers with different physiques.

* * * * *